United States Patent [19]

Lowrance, II et al.

[11] 4,369,032

[45] Jan. 18, 1983

[54] REHEAT FURNACE

[75] Inventors: Kenneth F. Lowrance, II, Dyer; Ferdinand Fiacco, Hebron, both of Ind.

[73] Assignee: Inland Steel Company, Chicago, Ill.

[21] Appl. No.: 251,372

[22] Filed: Apr. 6, 1981

Related U.S. Application Data

[63] Continuation of Ser. No. 54,007, Jul. 2, 1979, abandoned.

[51] Int. Cl.[3] ..... F27D 1/00

[52] U.S. Cl. ..... 432/247; 110/336; 52/573; 52/378

[58] Field of Search ..... 110/336–340; 432/247, 248, 251, 252; 266/285, 286; 52/378, 486, 573

[56] References Cited

U.S. PATENT DOCUMENTS

| | | | |
|---|---|---|---|
| 1,733,139 | 10/1929 | Stevenson | 266/285 |
| 1,754,514 | 4/1930 | Hobbs | 110/336 |
| 2,389,622 | 11/1945 | Hensel | 110/336 |
| 2,553,393 | 5/1951 | Webber | 110/336 |
| 2,827,784 | 3/1958 | Lambert | 110/336 |
| 2,865,196 | 12/1958 | Jack | 52/378 |
| 2,964,821 | 12/1960 | Meehan | 52/378 |
| 3,295,280 | 1/1967 | Kettner | 52/378 |
| 3,416,780 | 12/1968 | Hanna | 110/336 |
| 3,595,550 | 7/1971 | Greer | 266/286 |
| 3,869,996 | 3/1975 | Panferov et al. | 432/247 |

*Primary Examiner*—Henry C. Yuen

*Attorney, Agent, or Firm*—Merriam, Marshall & Bicknell

[57] ABSTRACT

Reheat furnaces for steel mills are constructed using resilient supporting mechanisms for restraining and supporting the binder structure within a rigid steel frame. This construction enables the furnace to be rebricked without affecting other furnaces in the battery and also allows the refractory lined wall to distort without disturbing the rigid frame.

7 Claims, 7 Drawing Figures

REHEAT FURNACE

This is a continuation of application Ser. No. 54007 filed July 2, 1979 now abandoned.

Operators of steel mills continually search for ways to keep the mill producing even during maintenance and repairs. However, this task is not simple since each unit in the production line depends upon the others so in many cases when one unit is removed from production, upstream and downstream units are also affected.

Key units in many steel mills are reheat furnaces such as annealing furnaces in which stresses are relieved in fabricated parts and soaking pits in which ingots are often stored at elevated temperature prior to rolling. Typically, a reheat furnace is a refractory lined chamber or furnace with a removable cover which can be maintained at temperatures around 2100° F. to 2500° F. In the usual operation, the cover is removed while steel is placed in the furnace; then the cover is replaced as quickly as possible. To facilitate this operation, the steel is usually handled by large overhead cranes while the covers are removed by a cover carriage which rides on rails attached to the framework of the furnace. In this manner, the use of two cranes can be avoided.

While this method works well initially, it breaks down over time when the conventional reheat furnace construction is used since the refractory bricks which line the furnace change shape with time. In particular, at high temperature cracks and crevices form in the bricks; then oxides from the steel or other debris becomes entrapped in these crevices. Upon cooling, the debris prevents the crevices from closing up which induces tensile stresses elsewhere in the brick, causing the cracks to grow. Upon reheating, the process repeats itself and eventually the refractory bricks begin to press outward on the framework of the reheat furnace, and the structure rapidly becomes loaded past its design limits and deforms the rails upon which the cover carriage rides and thus requires them to be reset. As the process repeats itself, the framework becomes excessively distorted and weakened and must be rebuilt, which ordinarily requires shutting down the entire battery of furnaces with a consequent loss of production.

The present invention involves a reheat furnace which does not possess these disadvantages. The reheat furnace of the present invention comprises a rigid frame, a plurality of movable plates within the frame defining a cavity, the plates being spaced from the rigid frame and resilient means such as springs which urge the plates toward the center of the cavity but allow them to deflect and recover. The inside of the cavity is lined with refractory material. This construction allows the refractory material to deform extensively without loading the framework beyond its design limits. When the loading on the frame approaches the design limits, the furnace is rebricked and the process can be repeated. Thus the plates may move and deform but the elements of the frame do not become stressed beyond their elastic limits.

DETAILED DESCRIPTION OF THE PREFERRED EMBODIMENT

For purposes of the present invention, the reheat furnace includes four main components: the foundation; the steel clad, refractory lined furnace walls; the rigid restraining framework; and the resilient supporting mechanisms which provide lateral support for and urge the steel clad, refractory lined furnace wall inward.

Figure 1:
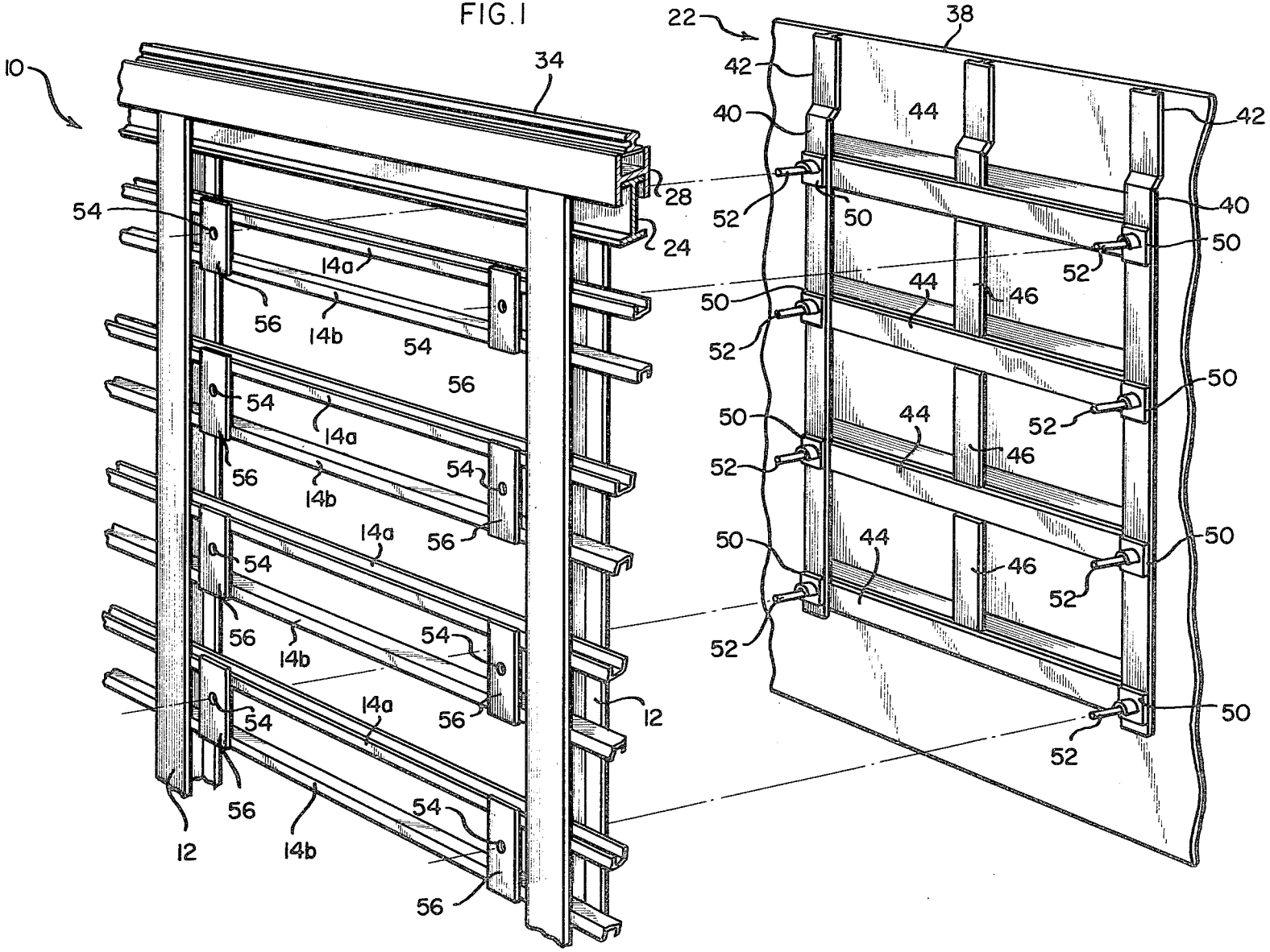
FIG. 1 is an exploded perspective view illustrating the relationship between the framework and the wall (binder structure) of the reheat furnace.
Figure 2:
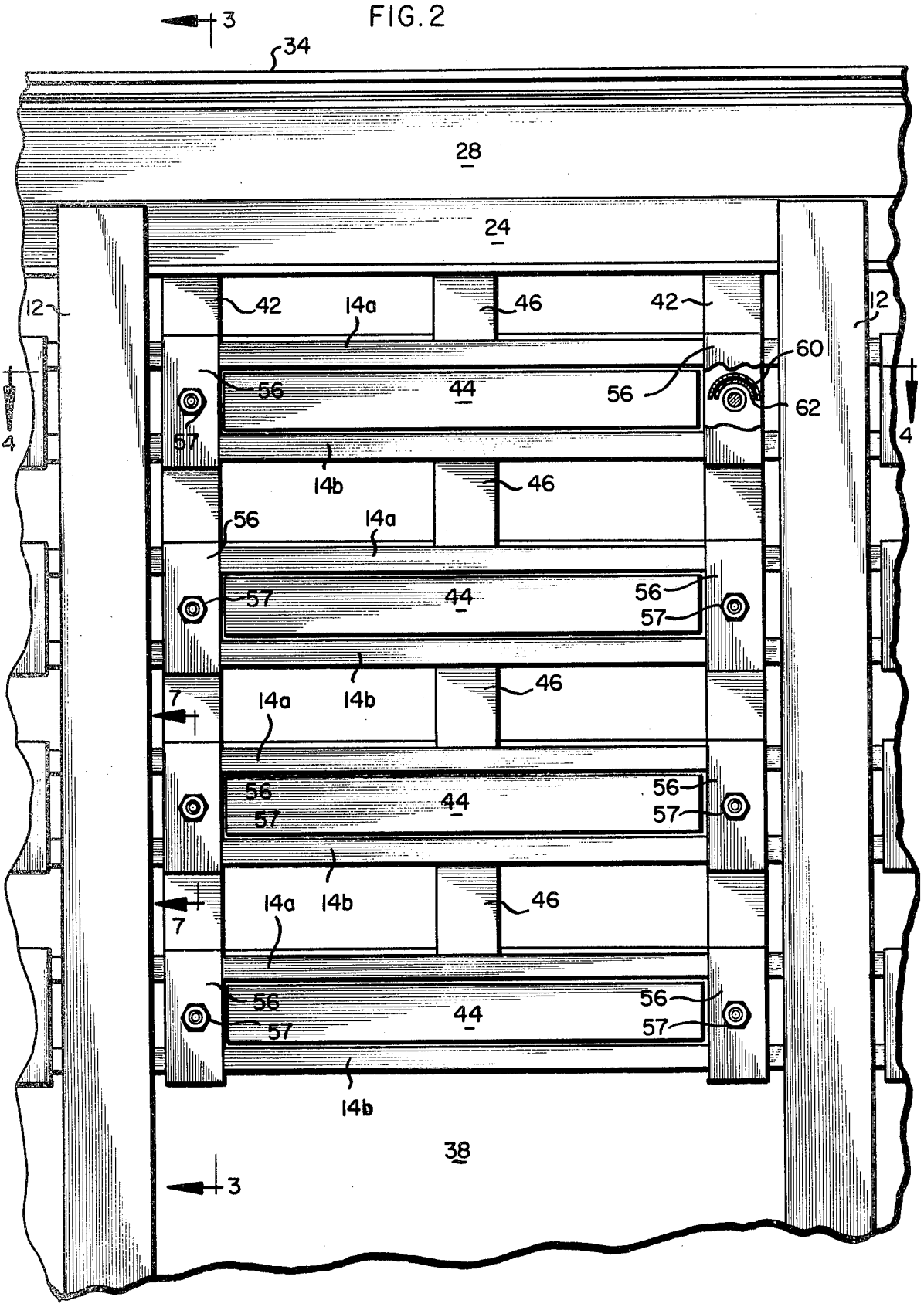
FIG. 2 is a front elevational view which illustrates a portion of a wall of a reheat furnace of the present invention.
Figure 3:
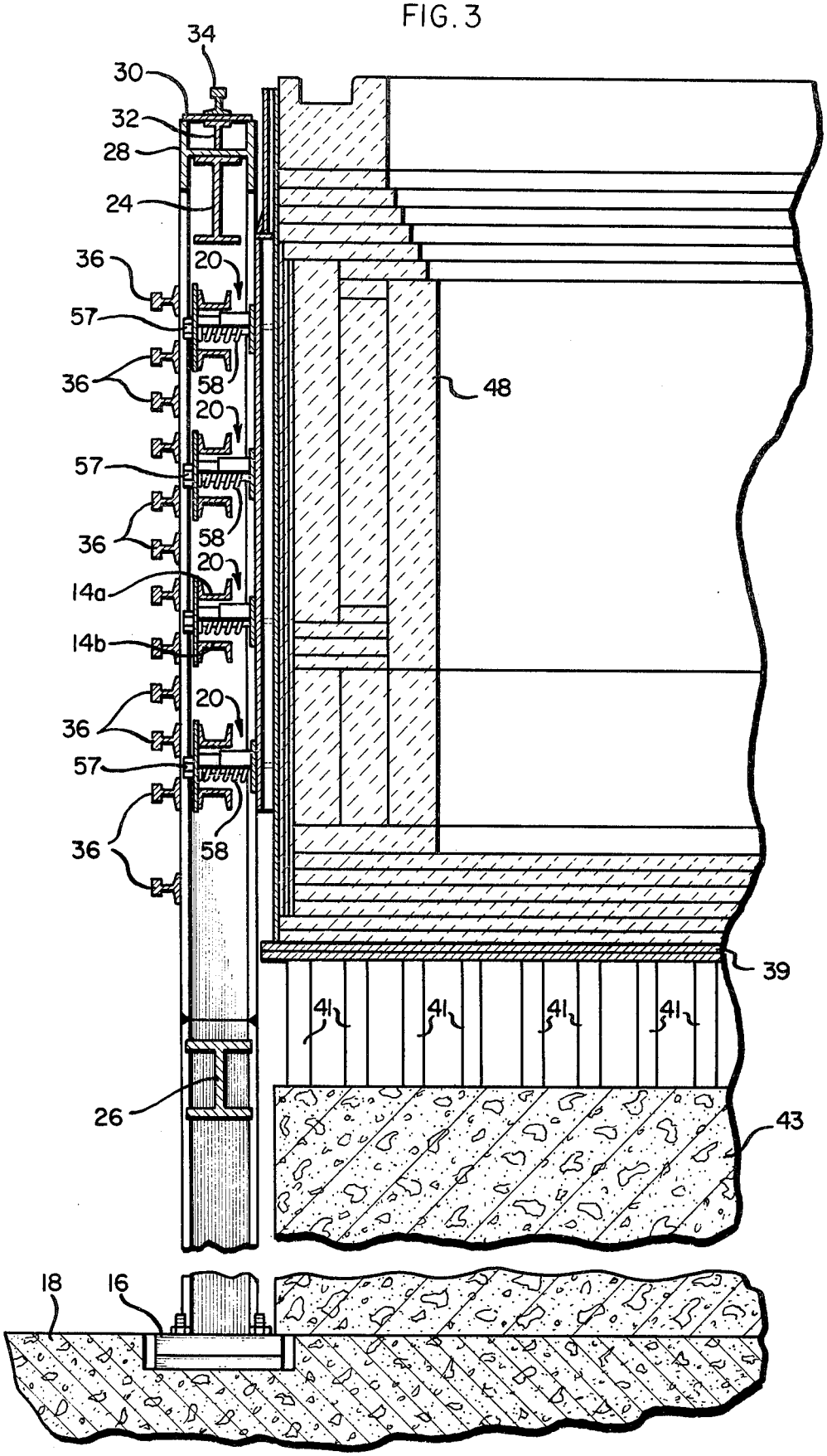
FIG. 3 is a sectional view along line 3—3 in FIG. 2 illustrating the internal construction of a wall of a reheat furnace of the present invention.
Figure 7:
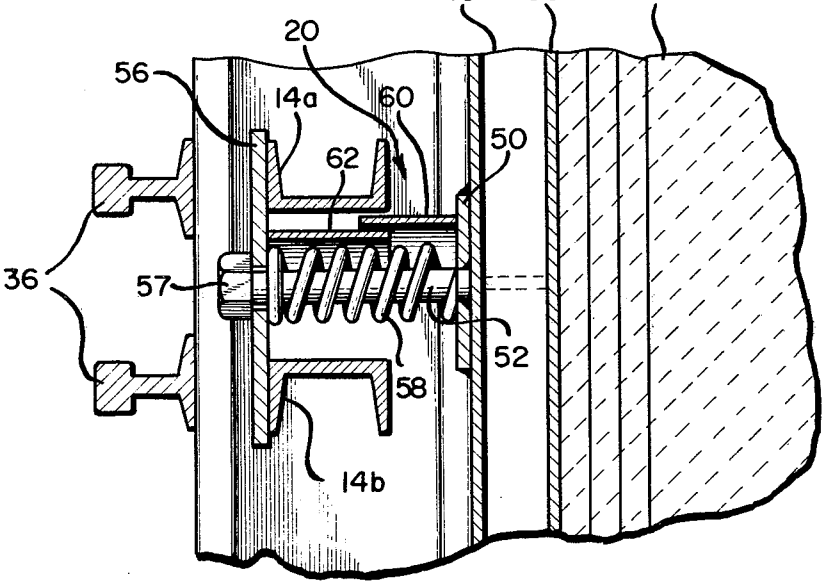
FIG. 7 is an enlarged sectional view along line 7—7 in FIG. 2.

The construction of the frame of the reheat furnace of the present invention is best understood by reference to FIGS. 1, 2 and 3 in which rigid frame 10 consisting of vertical columns (buckstays) 12 and horizontal girders 14*a* and 14*b* is mounted on horizontal foundation plate 16 which is bolted to foundation 18. Each upward opening horizontal girder 14*a* is welded into place between two upright columns 12 and is paired with a downward opening horizontal girder 14*b* which is welded into place a spaced distance below, thus leaving room between the two for resilient mounting mechanism 20 (FIG. 3) which urges an upright wall means or binder structure 22 inward. Near the top and bottom of the framework, horizontal I beams 24 and 26, respectively, extend between each adjacent pair of columns 12 to impart greater rigidity to the frame. Continuous horizontal I beam 28 is welded to the tops of vertical columns 12 and supports horizontal plate 30 which is welded between the flanges of I beam 28. T-bar 32 is positioned between the web of I beam 28 and horizontal plate 30, while the bottom of the "T" is welded to the web of I-beam 28. Horizontal rail 34 is mounted on plate 30 and with another similarly supported rail (not shown) on the opposite side of the reheat furnace provides support for the overhead cover carriage (not shown) which is used to remove the furnace covers when steel ingots are being placed in or removed from the furnace. To further strengthen the framework, horizontal rails 36 are welded to the exterior of columns 12. (Rails 36 are omitted from FIGS. 1 and 2 to avoid obscuring the underlying structure but are shown in FIGS. 3 and 7.) Rails 36 also serve to protect framework 10 from accidental damage which might result from moving steel in and out of the holding space to the left of the framework in FIG. 3.

Figure 4:
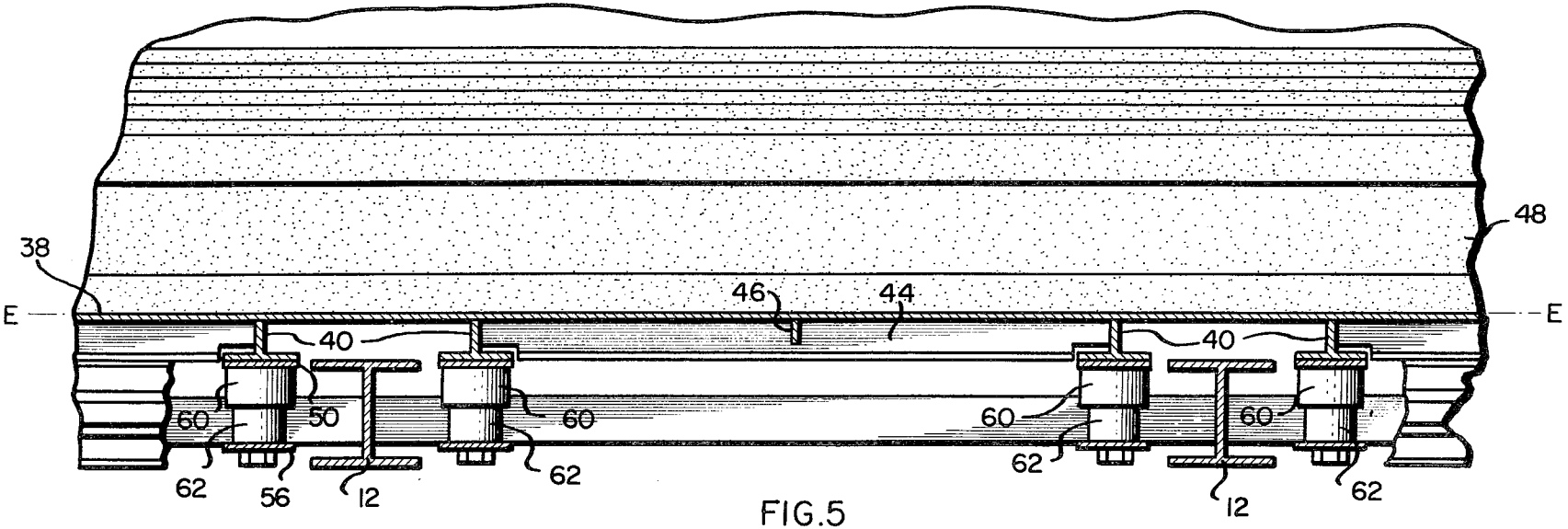
FIG. 4 is a sectional view along line 4—4 in FIG. 2 illustrating the internal construction of a reheat furnace of the present invention prior to substantial use.

The structure of the steel clad, refractory lined wall 22 is best understood by referring to FIGS. 1, 2, 3 and 4 in which binder plate 38 resting on hearth plate 39 defines the exterior of a refractory lined cavity and serves to restrain the relative movement of refractory elements 48 with respect to each other. Hearth plate 39 is supported by vertical steel plates 41 resting on slab 43 on foundation 18. As shown in FIGS. 1 and 4, binder plate 38 is reinforced with vertical T-bars 40 extending substantially the height of binder plate 38. The bottom of the "T" of each T-bar 40 is welded to the binder plate. Near the top of binder plate 38, vertical T-bars 42 having shorter uprights than T-bars 40 are used to avoid interference with horizontal I beam 28. As seen in FIGS. 1, 2 and 4, horizontal T-beams 44 welded to binder plate 38 extend between, but do not touch, vertical T-bars 40. Vertical reinforcing T-bars 46 are welded to binder plate 38 and extend between horizontal T-beams 44, but vertical reinforcing T-bars 46 are not welded to horizontal T-beams 44 but instead a small gap is left. The inner side of binder plate 38 forming the interior of the reheat furnace is lined with refractory elements such as brick 48 in any usual manner.

The rigid frame 10 and the steel clad refractory wall 22 are connected to each other by the resilient supporting mechanisms 20 which provide lateral support for binder plate 38 as is best understood by referring to FIGS. 1, 3 and 7.

Figure 5:
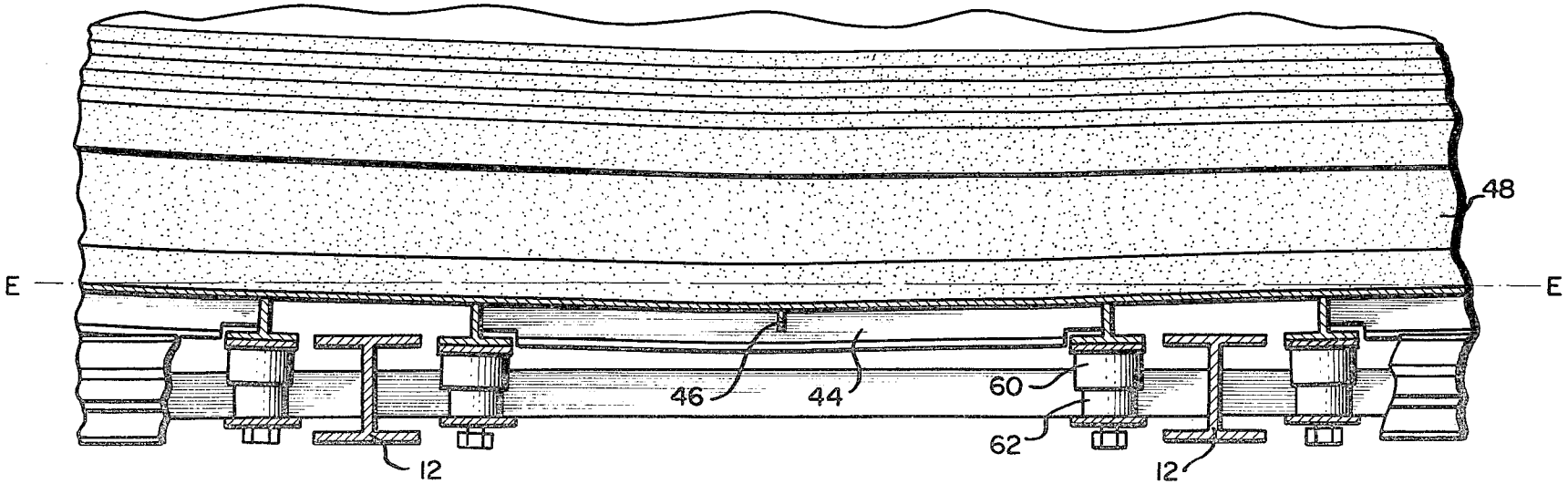
FIGS. 5 and 6 illustrate the distorted shapes that the wall of the reheat furnace may assume after prolonged use.
Figure 6:
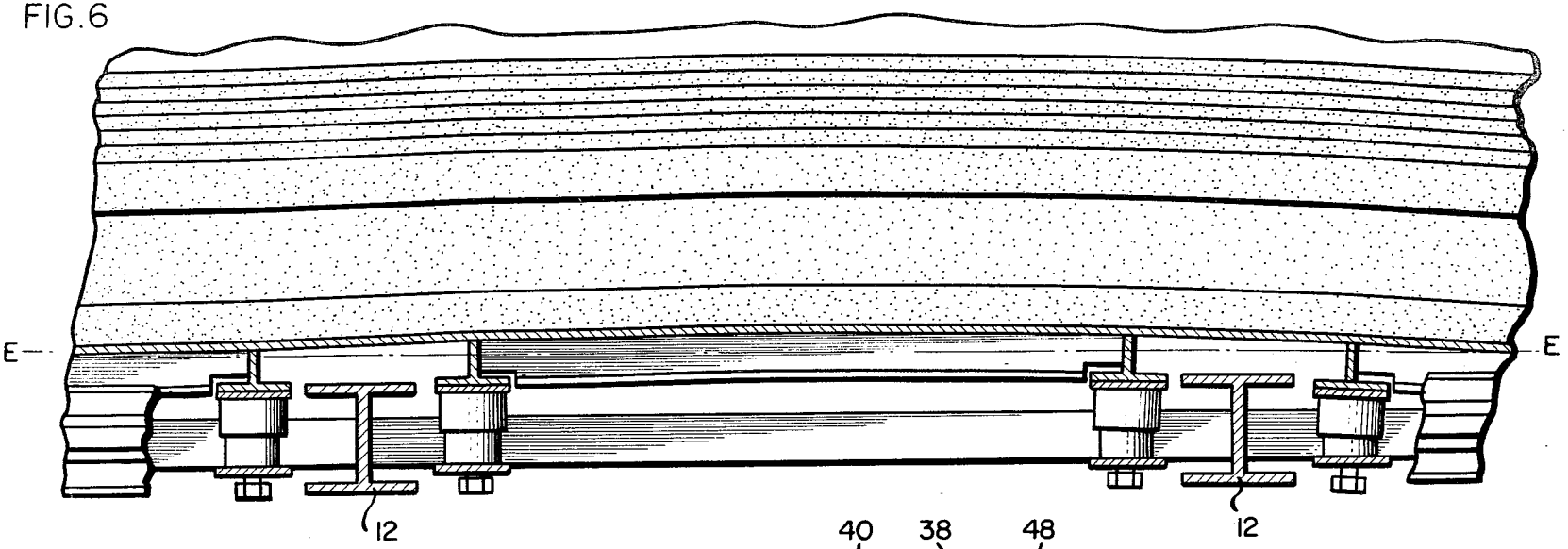

As shown in FIG. 1, support blocks 50 are welded to vertical T-bars 40, and threaded rods 52 project from blocks 50 and align with apertures 54 in support blocks 56 which are welded into place between adjacent girders 14*a* and 14*b* in frame 10. As shown in FIGS. 3 and 7, coil springs 58 surround each threaded rod 52 and press against support blocks 50 and support plates 56. Since the spring constant of springs 58 is known, rods 52 also serve as indicators in the sense that the load on frame 10 can be determined by measuring the protrusion of rods 52 beyond their initial positions with respect to apertures 54 in support blocks 56. Nuts 57 mounted on threaded rods 52 function as retainer means to prevent threaded rods 52 from becoming displaced from apertures 54 in support blocks 56 upon movement of binder plate 38. Half cylindrical shell 60 is welded onto support block 50 above threaded rod 52 and serves to shield coil spring 58 from debris which might be dropped onto it. Similarly, half-cylindrical shell 62 is welded onto support plate 56 above aperture 54 and similarly serves to shield coil spring 58. Conveniently, shell 62 telescopes within shell 60; thus shielding can be maintained even as refractory brick 48 expands, contracts and distorts during use. As seen in FIGS. 5, 6 and 7, clearance is left between shell 62 and shell 60 to allow telescoping even when, as in FIGS. 5 and 6, the binder plate is not parallel to the plane defined by rigid frame 10.

It is important to realize that binder plate 38 is actually held in place by the force exerted by coil springs 58 in resilient supporting mechanisms 20 and that binder plate 38 would fall over against frame 10 but for the force of springs 58. This aspect of the invention is crucial for it allows binder structure 22 to deform and assume permanent changes in shape without overloading frame 10. If rigid members are used to restrain binder structure 22 then this ability of the entire structure to accommodate the deformation of binder structure 22 without overloading frame 10 will be lost.

FIG. 4 illustrates the reheat furnace wall as built while FIGS. 5 and 6 illustrate configurations assumed during use. In FIG. 4, binder plate 38 is substantially planar and defines the initial equilibrium line E—E, while in FIG. 5, refractory 48 has grown somewhat by the process described previously and binder plate 38 is bowed out from the initial equilibrum position at line E—E, but frame 10 is essentially intact at line E—E. In FIG. 6, the binder plate has become bowed inward from line E—E. It is important to note that in all of the distorted states, frame 10 is not loaded beyond its design limits. When the distortion becomes severe enough that the springs 58 are almost fully compressed and binder structure 22 approaches frame 10, the furnace is taken out of service for rebricking but other furnaces in the battery may still be used while the rebricking is taking place if a suitable cover is placed over the furnace being rebricked.

When previous rigid constructions were used, the rails 34 for the cover carriage had to be reset periodically which had extremely expensive consequences including taking many reheat furnaces out of service and perhaps even shutting down an entire production line. To avoid these consequences, the rails were not reset until it became absolutely necessary or the line was shut down for some other reason. This delay had its costs since often the rails were not spaced at the optimum distance from each other imposing severe loads on the wheels and wheel mounting (bearings, axles and the like) which caused premature failure of the cover carriage and thus removed several furnaces from service.

As mentioned previously, even though the refractory material changes shape during use, resulting in the binder plate deflecting and following the motion of the refractory, frame 10 is not distorted since binder plate 38 can move outwardly without excessively loading frame 10, since binder plate 38 is yieldably restrained by the resilient mounting mechanisms 20. Thus the rails do not have to be periodically reset to accommodate the cover carriage, and the wheels, bearings and axles on the cover carriage do not wear out as quickly since the rails may be spaced the optimum distance from each other and they will remain so spaced as long as the design limits of frame 10 are not exceeded.

Another advantage realized from this resilient construction results from the refractory and steel lining retaining its integrity longer which conserves energy and makes it possible to heat ingots more quickly. The energy losses from even a small hole are very severe when the temperature of the interior of the furnace is over 2100° F.

Still another advantage resides in the fact that with previous rigid constructions, the steel framework would require periodic replacement which is unnecessary with the present resilient construction. Thus again the present construction eliminates another cause of expensive shut downs.

An additional advantage of spring loading the binder wall is found in its ability to absorb the impact of dropped or falling ingots. Thus the damage done to the refractory and the structure is less than would be done in a similar accident if the rigid construction were used.

It will be apparent that many modifications and variations on the foregoing preferred embodiment will be apparent to those skilled in the art, so only such limitations as appear in the following claims should be placed upon the invention.

As our invention, we claim:

1. A reheat furnace comprising:

a rigid frame;

upright wall means defining a refractory element lined cavity disposed within said frame, said wall means including a binder structure between said refractory elements and said frame for limiting the relative movement of said refractory elements with respect to each other;

resilient means engaging said rigid frame and said binder structure for movably supporting said binder structure and resiliently urging said binder structure inwardly of said cavity, said resilient means being yieldable to accomodate deflection of said binder structure toward said frame without overloading the latter; and sheild means disposed above said resilient means for protecting said resilient means from debris;

said shield means comprising a pair of shield members, one of said shield members being mounted on said frame and the other of said shield members being mounted on said binder structure, said shield members extending toward each other and overlapping with clearance therebetween so as to maintain protection of said resilient means during deflection of said binder structure even when said binder structure is not parallel to said frame.

2. The reheat furnace of claim 1 wherein said resilient means comprises a plurality of coil spring members, and said shield means comprises a plurality of pairs of telescoping shell members, one shell member of each pair being mounted on said frame, and the other shell member being mounted on said binder structure.

3. The reheat furnace of claim 2 wherein said shell members are half-cylindrical in shape and are disposed above said spring members with clearance between said shell members to allow telescoping even when said binder structure is not parallel to said frame.

4. The reheat furnace of claim 1 wherein said frame includes means defining a plurality of apertures; said binder structure includes a plurality of rods projecting outwardly from said binder structure and extending through said apertures; and said resilient means comprises a coil spring disposed around each of said rods and engaging said binder structure and said frame.

5. The reheat furnace of claim 4 further comprising retainer means secured to the ends of said rods that extend through said apertures for preventing said rods from becoming displaced from said apertures upon movement of said binder structure.

6. The reheat furnace of claim 4 further characterized in that said rods also serve as indicators of the load on said frame by the extent of protrusion of said rods beyond their initial positions with respect to said apertures.

7. The reheat furnace of claim 1 further characterized in that said furnace comprises a soaking pit furnace for heating ingots and having rails mounted on said frame for supporting an overhead cover carriage which is used to remove a furnace cover when ingots are being placed in or removed from the furnace, said resilient means functioning to avoid overloading of said frame and deformation of said rails.

* * * * *